US005535889A

United States Patent [19]

Lin

[11] Patent Number: 5,535,889

[45] Date of Patent: Jul. 16, 1996

[54] CANTEEN WITH SOLID FOOD COMPARTMENT

[75] Inventor: Bang H. Lin, Taipei, Taiwan

[73] Assignee: Shing Hong Industrial Co., Ltd., Tainan, Taiwan

[21] Appl. No.: 429,931

[22] Filed: Apr. 27, 1995

[51] Int. Cl.[6] ..... B65D 21/02

[52] U.S. Cl. ..... 206/546; 206/547; 220/4.27; 220/23.4

[58] Field of Search ..... 220/256, 253, 220/4.27, 23.83, 23.86, 23.4; 206/541, 546, 547

[56] References Cited

U.S. PATENT DOCUMENTS 2,326,414 8/1943 Thompson ..... 220/4.27
3,485,416 12/1969 Fohrman ..... 220/4.27
5,072,849 12/1991 Blau ..... 220/253
5,086,926 2/1992 Paige et al. ..... 220/4.27 X

*Primary Examiner*—Jacob K. Ackun
*Attorney, Agent, or Firm*—Brinks Hofer Gilson & Lione

[57] ABSTRACT

A canteen includes a canteen body which confines a compartment for storing refreshments therein, a food container which has a container body that is mounted to a base of the canteen body and that confines a compartment for storing solid food therein, and a base plate that is mounted on an open bottom of the container body and that is formed with an access hole to access the compartment of the container body, and a cover plate which is mounted movably to the food container so as to cover selectively the access hole.

6 Claims, 4 Drawing Sheets

CANTEEN WITH SOLID FOOD COMPARTMENT

BACKGROUND OF THE INVENTION

1. Field of the Invention

The invention relates to a canteen, more particularly to a canteen with a compartment for receiving solid food therein.

2. Description of the Related Art

Snacks and refreshments are usually brought along when camping. Refreshments, such as water and other liquids, are stored in a canteen, while snacks, such as candies and the like, are placed in a separate bag or container.

SUMMARY OF THE INVENTION

The object of the present invention is to provide a canteen with a compartment for receiving solid food therein.

Accordingly, the canteen of the present invention comprises: a canteen body which confines a compartment for storing refreshments therein; a food container which includes a container body that is mounted to a base of the canteen body and that confines a compartment for storing solid food therein, and a base plate that is mounted on an open bottom of the container body and that is formed with an access hole to access the compartment of the container body; and a cover plate which is mounted movably to the container so as to cover selectively the access hole.

The cover plate is disposed below the base plate and is mounted rotatably to the base plate. The cover plate is formed with opening which is to be aligned selectively with the access hole.

Preferably, the container body is mounted removably to the base of the canteen body.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
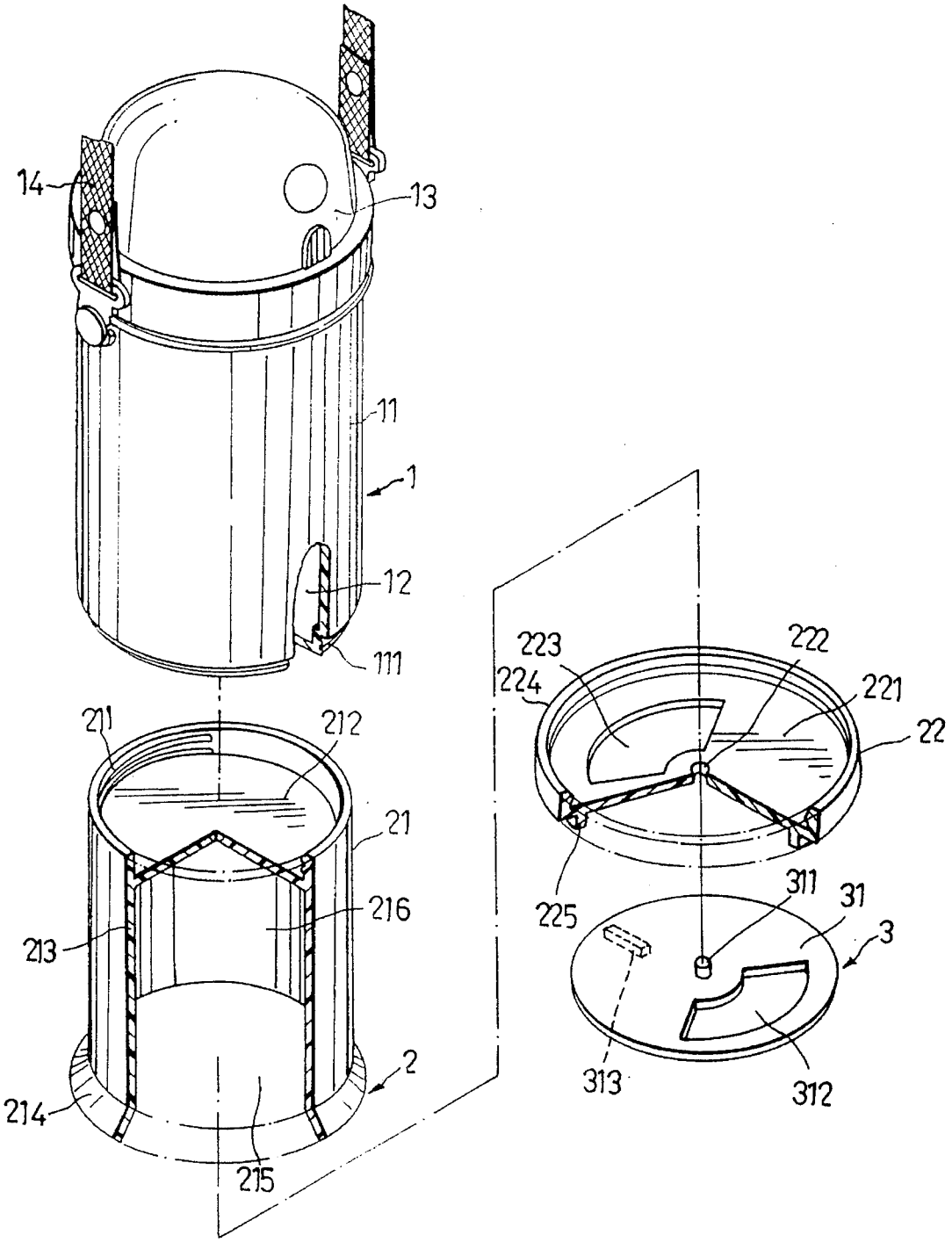
FIG. 1 is an exploded view of the first preferred embodiment of a canteen according to the present invention.

Referring to FIG. 1, the first preferred embodiment of a canteen according to the present invention is shown to comprise a canteen body 1, a food container 2 and a cover plate 3.

The canteen body 1 includes a cylindrical vessel 11 which confines a compartment 12 for storing refreshments, such as water or other liquids, therein. A cap 13 is mounted removably on an open top of the cylindrical vessel 11 to close the compartment 12. The cylindrical vessel 11 is provided with a strap 14 to facilitate carrying of the canteen body 1. Finally, the cylindrical vessel 11 has a base that is formed with an externally threaded connecting portion 111.

Figure 2:
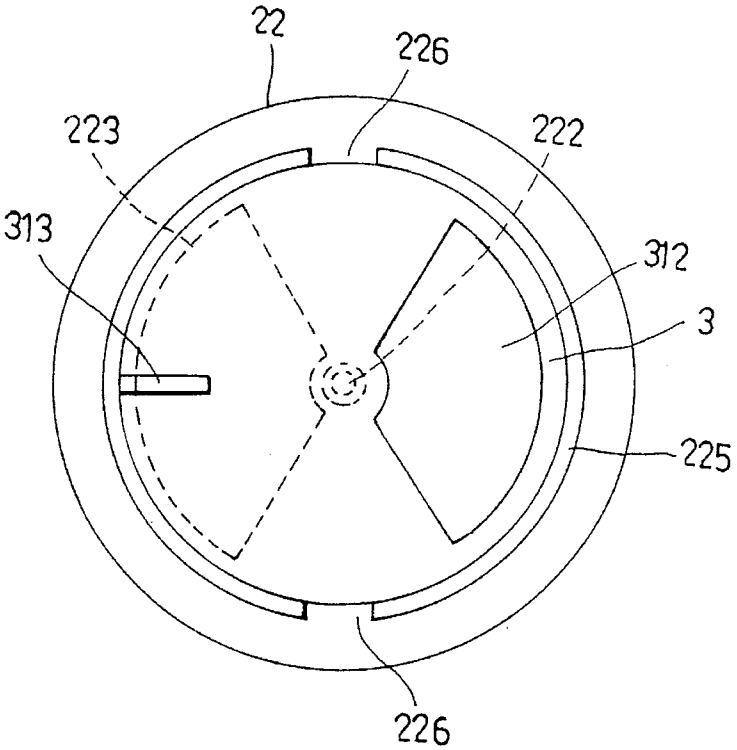
FIG. 2 is a bottom view illustrating a cover plate of the first preferred embodiment when in a closed position.

The food container 2 includes a container body 21 and a base plate 22. The container body 21 is configured as a seat for the cylindrical vessel 11 of the canteen body 1 and has an annular surrounding wall 213. The surrounding wall 213 has a distal top section formed with an internally threaded connecting portion 211 which is capable of mating removably with the connecting portion 111 of the cylindrical vessel 11, a top plate 212 disposed below the distal top section, and a flaring bottom section 214. The container body 21 confines a compartment 216 which is accessible through an open bottom 215 defined by the bottom section 214. The base plate 22 includes a circular plate body 221 aligned with the open bottom 215. The plate body 221 is formed with a central positioning hole 222 and an eccentric fan-shaped access hole 223. Preferably, the size of the access hole 223 should not be larger than one-half of the cover plate 3. The plate body 221 is further formed with an upwardly projecting peripheral rim 224 which is capable of engaging the flaring bottom section 214 of the container body 21, and a downwardly projecting support ring 225. The support ring 225 is formed with a pair of diametrically opposite notches 226, as shown in FIG. 2.

The cover plate 3 serves to cover selectively the access hole 223. The cover plate 3 is disposed below the base plate 22 and is confined rotatably by the support ring 225. The cover plate 3 includes a circular plate body 31 which is provided with an upwardly projecting central positioning pin 311 that is extendible through the positioning hole 222 in the base plate 22. The plate body 31 is further formed with an eccentric fan-shaped opening 312 which is to be aligned selectively with the access hole 223 and which is slightly smaller than the latter, and a downwardly projecting handle 313.

Figure 3:
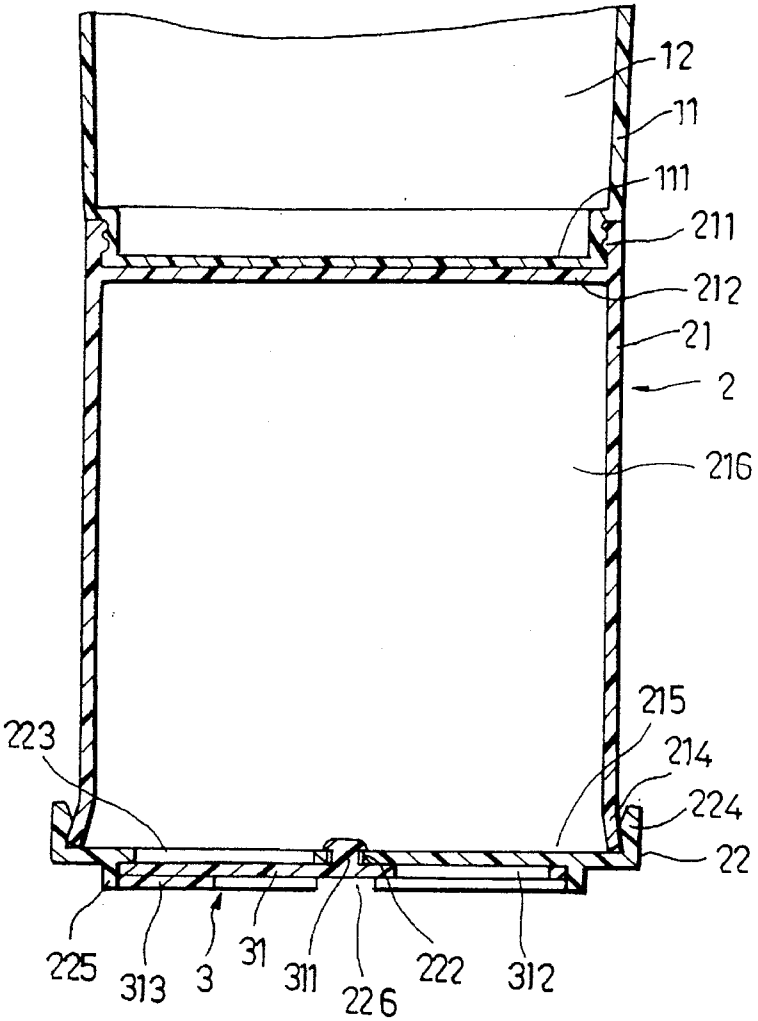
FIG. 3 is a fragmentary sectional view of the first preferred embodiment which illustrates the cover plate when in the closed position.

Assembly of the first preferred embodiment is performed as follows: Referring to FIGS. 2 and 3, the cover plate 3 is disposed below the base plate 22, and the positioning pin 311 is extended through the positioning hole 222. The tip of the positioning pin 311 is melted to expand its size and mount rotatably and non-removably the cover plate 3 to the base plate 22 in the support ring 225. The peripheral rim 224 of the base plate 22 engages the flaring bottom section 214 of the container body 21 to mount the base plate 22 to the container body 21. The connecting portion 211 of the container body 21 engages threadedly the connecting portion 111 of the cylindrical vessel 11 to mount removably the food container 2 to the canteen body 1.

In use, the compartment 12 of the canteen body 1 stores refreshments, such as water or other liquids, therein. The base plate 22 is detached from the container body 21 when storing solid food, such as gum, candies, nuts, chocolates and the like, in the compartment 216 of the food container 2. The base plate 22 is replaced on the container body 21 when the compartment 216 is filled. Thus, the canteen of this invention facilitates bringing of both refreshments and snacks due to the provision of an additional compartment for receiving solid food therein.

Initially, the opening 312 in the cover plate 3 is misaligned with the access hole 223 in the food container 2.

Figure 5:
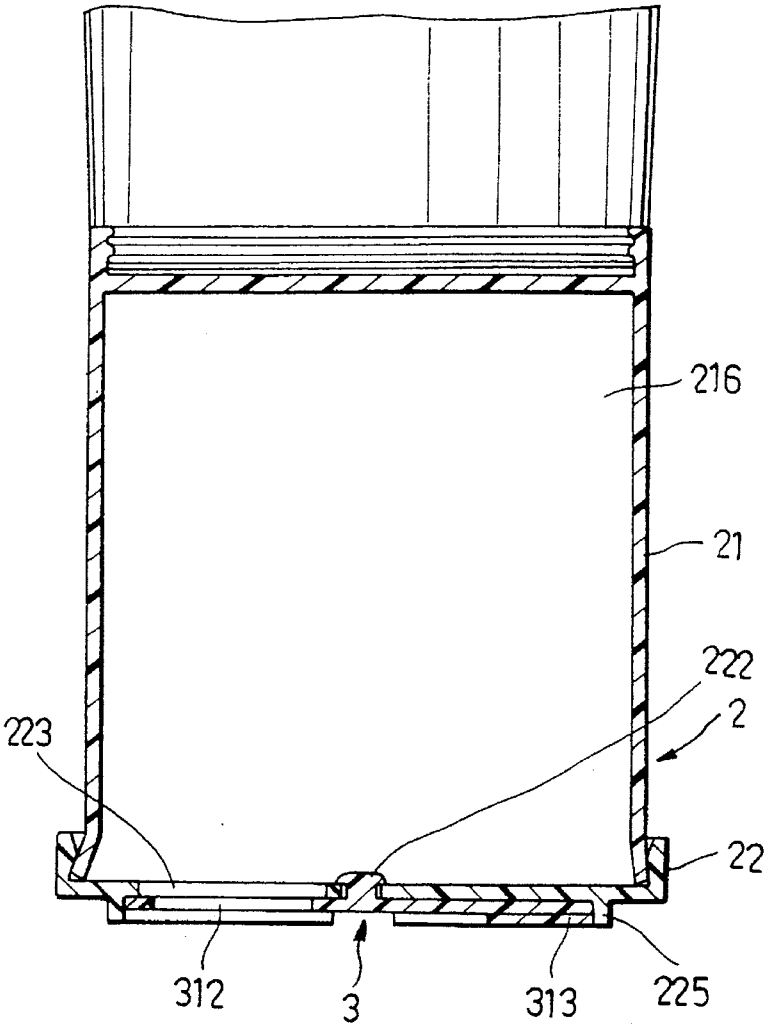
FIG. 5 is a fragmentary sectional view of the first preferred embodiment which illustrates the cover plate when in the open position.
Figure 4:
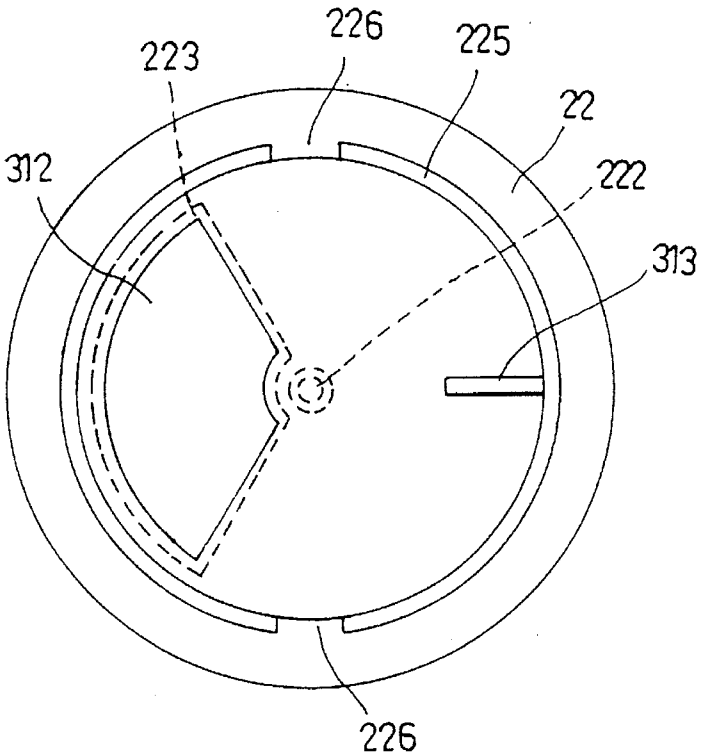
FIG. 4 is a bottom view illustrating the cover plate of the first preferred embodiment when in an open position.

Thus, the cover plate 3 covers the access hole 223. Referring to FIGS. 4 and 5, when retrieving solid food from the food container 2, the handle 313 is operated to rotate the cover plate 3 so as to align the opening 312 with the access hole 223, thereby permitting retrieving of the solid food in the compartment 216 of the food container 2. The handle 313 is operated to rotate the cover plate 3 so as to close the access hole 223 after retrieving food from the food container 2.

Since the food container 2 is detachable from the canteen body 1, the food container 2 can be separated from the canteen body 1 when retrieving food therefrom.

Figure 6:
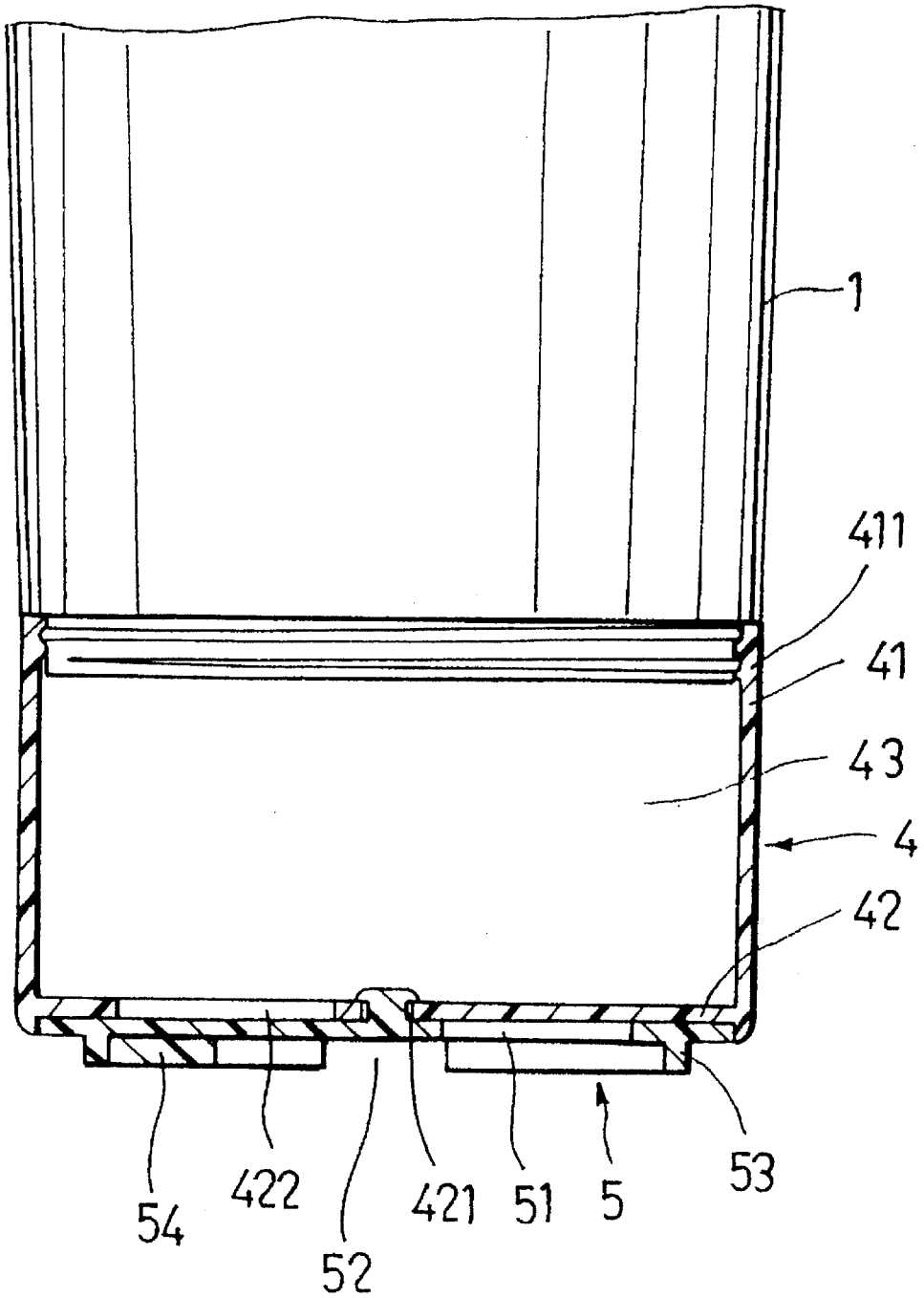
FIG. 6 is a fragmentary, partly sectional view of the second preferred embodiment of a canteen according to the present invention.

FIG. 6 illustrates the second preferred embodiment of a canteen according to the present invention. As shown, the second preferred embodiment is substantially similar to the previous embodiment. However, in the second preferred embodiment, the container body 41 and the base plate 42 of the food container 4 are formed integrally. The container body 41 has a distal top section formed with an internally threaded connecting portion 411 which is capable of mating removably with the base of the canteen body 1, and confines a compartment 43. The base plate 42 is formed with a central positioning hole 421 and an eccentric access hole 422. The cover plate 5 is disposed below the base plate 42 and is formed with an eccentric opening 51 which is to be aligned selectively with the access hole 422. The cover plate 5 is further formed with a downwardly projecting support ring 53 that has a pair of diametrically opposite notches 52 (only one notch 52 is shown). A handle 54 projects inwardly and radially from the support ring 53.

The connection between the food container and the canteen body should not be limited to the threaded connection described beforehand. Other forms of connection can be used as long as the food container can be detached from the canteen body. In addition, a hook member (not shown) may be employed instead of the positioning pin when mounting rotatably the cover plate to the base plate of the food container.

The support ring, which is formed with a pair of notches, is used to prevent water spilled on a table surface from reaching the compartment of the food container. The handle facilitates rotation of the cover plate.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A canteen, comprising:

a canteen body which confines a compartment for storing refreshments therein;

a food container which includes a container body that is mounted to a base of said canteen body and that confines a compartment for storing solid food therein, and a base plate that is mounted on an open bottom of said container body and that is formed with an access hole to access said compartment of said container body; and a cover plate which is mounted movably to said food container so as to cover selectively said access hole;

wherein said cover plate is disposed below said base plate and is mounted rotatable to said base plate, said cover plate being formed with an opening which is to be aligned selectively with said access hole.

2. The canteen as claimed in claim 1, wherein said base plate is formed with a downwardly projecting support ring, said support ring confining rotatably said cover plate therein and being formed with at least one notch.

3. The canteen as claimed in claim 1, wherein said container body is mounted removably to said base of said canteen body.

4. The canteen as claimed in claim 3, wherein said base of said canteen body is formed with an externally threaded connecting portion, said container body having a top section formed with an internally threaded connecting portion which engages threadedly said connecting portion on said base of said canteen body.

5. The canteen as claimed in claim 1, wherein said container body has a flaring bottom section which defines said open bottom, said base plate being formed with an upwardly projecting peripheral rim which engages said flaring bottom section to mount said base plate to said container body.

6. The canteen as claimed in claim 1, wherein said cover plate is formed with a downwardly projecting handle.

* * * * *

UNITED STATES PATENT AND TRADEMARK OFFICE

CERTIFICATE OF CORRECTION

PATENT NO. : 5,535,889

DATED : July 16, 1996

INVENTOR(S) : Bang H. Lin

It is certified that error appears in the above-indentified patent and that said Letters Patent is hereby corrected as shown below:

Column 4, line 20, claim 1, please delete "rotatable" and substitute --rotatably--.

Signed and Sealed this

Twenty-first Day of January, 1997

*Attest:*

*Attesting Officer*

BRUCE LEHMAN

*Commissioner of Patents and Trademarks*